US011066846B1

(12) United States Patent
Hernandez

(10) Patent No.: US 11,066,846 B1
(45) Date of Patent: Jul. 20, 2021

(54) FENCE SYSTEM

(71) Applicant: Mitchael D. Hernandez, Miami, FL (US)

(72) Inventor: Mitchael D. Hernandez, Miami, FL (US)

(73) Assignee: Aluminm Architectural Solutions, Inc., Doral, FL (US)

( * ) Notice: Subject to any disclaimer, the term of this patent is extended or adjusted under 35 U.S.C. 154(b) by 253 days.

(21) Appl. No.: 16/440,205

(22) Filed: Jun. 13, 2019

(51) Int. Cl.
*E04H 17/16* (2006.01)

(52) U.S. Cl.
CPC ..... *E04H 17/168* (2013.01)

(58) Field of Classification Search
CPC . E04H 17/1426; E04H 17/143; E04H 17/146; E04H 17/165; E04H 17/166; E04H 17/168
See application file for complete search history.

(56) References Cited

U.S. PATENT DOCUMENTS 4,266,385 A * 5/1981 Oehlert ..... E04D 3/362 52/521
4,964,618 A * 10/1990 Kennedy ..... E01F 8/007 256/24
5,140,793 A * 8/1992 Knudson ..... E04D 3/363 52/520
5,725,201 A * 3/1998 Parth ..... E04H 17/1417 256/24
5,758,467 A * 6/1998 Snear ..... E04C 2/20 52/177
6,122,877 A * 9/2000 Hendrickson ..... E04F 13/0864 52/233
6,226,950 B1 * 5/2001 Davis ..... C08L 23/10 52/100
6,311,955 B1 * 11/2001 McGarry ..... E04H 17/1417 256/24
D621,061 S 8/2010 Petrucelli et al.
8,794,598 B2 8/2014 Carbines
D738,530 S 9/2015 Thomas et al.
D738,535 S 9/2015 Bucarizza
D764,071 S 8/2016 Studebaker
D780,323 S 2/2017 Wu
D825,079 S 8/2018 Filiba
10,267,057 B2 * 4/2019 Goodrich ..... E04H 17/1426
2008/0157049 A1 7/2008 Robbins
(Continued)

FOREIGN PATENT DOCUMENTS

JP 2006016820 * 6/2004 ..... E04H 17/16
JP 2006016820 A 6/2004
(Continued)

*Primary Examiner* — Matthew R McMahon
(74) *Attorney, Agent, or Firm* — Albert Bordas, P.A.

(57) ABSTRACT

The present invention refers to a fence system having a plurality of panel assemblies. The panel assemblies of the plurality of panel assemblies interconnect to one another, whereby first and second interlocking structures extend along planes of each panel assembly to mount onto an adjacent panel assembly. The first interlocking structure has an intermediate wall and the second interlocking structure has a fastening wall that hides a fastener passing through the intermediate wall when panel assemblies of the plurality of panel assemblies are interconnected to one another. The plurality of panel assemblies mounts onto at least two posts.

9 Claims, 6 Drawing Sheets

(56) References Cited

U.S. PATENT DOCUMENTS

| | | | |
|---|---|---|---|
| 2010/0252793 | A1 | 10/2010 | Ash |
| 2011/0001105 | A1 | 1/2011 | Lo |
| 2018/0058092 | A1 | 3/2018 | Parisien |

FOREIGN PATENT DOCUMENTS

| | | | |
|---|---|---|---|
| WO | 2006122371 | A1 | 11/2006 |
| WO | 2010082848 | A1 | 7/2010 |

* cited by examiner

FENCE SYSTEM

BACKGROUND OF THE INVENTION

1. Field of the Invention

The present invention relates to fences, and more particularly, to fence systems having interlocking panels.

2. Description of the Related Art

Applicant believes that one of the closest references corresponds to U.S. Pat. No. 8,794,598 B2 issued to Richard James Carbines on Aug. 5, 2014 for Fence. However, it differs from the present invention because Carbines teaches a fence comprising at least two spaced-apart substantially upright fence posts anchored into the ground or other fixed structure and a stack of at least two boards extending between each pair of adjacent fence posts. Each board extends in a substantially horizontal orientation relative to the upright fence posts and is supported at each end by a respective fence post. At least one pair of retaining components are provided on each fence post and each pair of retaining components form a series of cavities that are each shaped to receive and retain a respective end of a board of the stack to thereby support the respective end of the board at the fence post.

Applicant believes that another reference corresponds to U.S. Pat. No. D621061 S issued to Petrucelli, et al. on Aug. 3, 2010 for Fence panel. However, it differs from the present invention because Petrucelli, et al. teach a different ornamental design of a fence panel.

Applicant believes that another reference corresponds to U.S. Pat. No. D738530 S issued to Thomas, et al. on Sep. 8, 2015 for Fence. However, it differs from the present invention because Thomas, et al. teach a different ornamental design of a fence.

Applicant believes that another reference corresponds to U.S. Pat. No. D738535 S issued to Vlado Bucarizza on Sep. 8, 2015 for Fence panel. However, it differs from the present invention because Bucarizza teaches a different ornamental design of a fence panel.

Applicant believes that another reference corresponds to U.S. Pat. No. D764071 S issued to Robert L. Studebaker on Aug. 16, 2016 for Graduated rail fence panel. However, it differs from the present invention because Studebaker teaches a different ornamental design of a graduated rail fence panel.

Applicant believes that another reference corresponds to U.S. Pat. No. D780323 S issued to Chun-Yin Wu on Feb. 28, 2017 for Fence. However, it differs from the present invention because Wu teaches a different ornamental design of a fence.

Applicant believes that another reference corresponds to U.S. Pat. No. D825079 S issued to Lusio Filiba on Aug. 7, 2018 for Fence. However, it differs from the present invention because Filiba teaches a different ornamental design of a fence.

Applicant believes that another reference corresponds to U.S. Patent Application Publication No. 20080157049 A1, published on Jul. 3, 2008 to Steven L. Robbins for Interlocking fence system and method. However, it differs from the present invention because Robbins teaches an interlocking fence system, whereby two spaced-apart upright posts attached to a grade supports an upper rail with an offset locking aperture and an alignment aperture, and further supports a lower rail with an alignment aperture. A picket has a locking slot with an edge of the locking aperture in the upper rail serving as a tab to restrict axial movement when inserted therein. Alignment aperture in the upper rail and alignment aperture in the lower rail serve to restrict lateral movement of the picket. To support the rails, retaining slots in the upper rail and retaining slots in the lower rail can be retained by an edge in support apertures in the posts.

Applicant believes that another reference corresponds to U.S. Patent Application Publication No. 20100252793 A1, published on Oct. 7, 2010 to Gary W. Ash for Fence rail with concealed fastener. However, it differs from the present invention because Ash teaches a fence rail that includes a detachable fastener cover that covers and conceals a fastener chamber. Through the use of a knuckle and a catch fastening system, moisture is prevented from entering the fastener chamber. The fastener chamber allows for securing pickets to the rail using a means for fastening as close to the top of the rail as possible thereby allowing for significant racking of the fence.

Applicant believes that another reference corresponds to U.S. Patent Application Publication No. 20110001105 A1, published on Jan. 6, 2011 to Chong-Yi Lo for Hidden-Fastener fence. However, it differs from the present invention because Lo teaches a hidden-fastener fence, which features wavelike seizing surfaces on the opposite inner walls of horizontal tubes of the fence and wavelike embedding verges are set up at both sides of horizontal plate of a fixing bar to fit in the seizing surfaces of the horizontal tube. The joining of the embedding verges at the both sides of the horizontal plate of the fixing bar and the seizing surfaces of the corresponding inner walls of the horizontal tube would prop the bottom opening of the horizontal tube outward, which considerably boosts the structural strength of the bottom opening of the horizontal tube, and the wavelike seizing surfaces on the inner walls of the horizontal tube further fortifies the rigidity of the horizontal tube.

Applicant believes that another reference corresponds to U.S. Patent Application Publication No. 20180058092 A1, published on Mar. 1, 2018 to Harvey Parisien for Interlocking fence panels. However, it differs from the present invention because Parisien teaches interlocking fence panels for interconnection between horizontal channeled rails in a fence system to improve interlocking fence panel members, which can interconnect for insertion between horizontal channeled rails to provide a one-piece continuous infill effect between these horizontal channeled rails in a fence system which, when interconnected with other panels and in place, will not become disengaged from one another and which will strengthen the stability and integrity of the fence system itself.

Applicant believes that another reference corresponds to JP Patent Application Publication No. 2006016820 A, published on Jun. 30, 2004 to Tatsuya Kimoto for Panel fence. However, it differs from the present invention because Kimoto teaches a panel, which is installed by inserting both end parts thereof into the groove parts of a U-shaped holding member mounted on columns oppositely to the side faces thereof. Since both end parts of the panel can be concealed by the U-shaped holding member, even if the panel is installed at the sloped part, the appearance can be improved, traffic noise can be reduced, mud spattering can be prevented from occurring, and the function of sealing can be prevented from being lowered without requiring the other members and the panel for sloped part for preventing the end part of the panel from being observed or a clearance from being opened.

Applicant believes that another reference corresponds to WO Patent Application Publication No. 2006122371 A1, published on Nov. 11, 2006 to Alan Brownbill for Panel with hidden attachment means. However, it differs from the present invention because Brownbill teaches a panel comprising a plurality of first members disposed in a first direction, at least some first members defining a first part of a passageway and being at least partially tubular, at least one second member disposed in a second direction and defining a second part of the passageway, the second member having a plurality of openings each for at least partially receiving a first member, and a locking member for each first member adapted to extend at least partially into the passageway to lock the first member relative to the second member.

Applicant believes that another reference corresponds to WO Patent Application Publication No. 2010082848 A1, published on Jul. 22, 2010 to Richard James Carbines for a Fence. However, it differs from the present invention because Carbines teaches a fence comprising at least two spaced-apart substantially upright fence posts anchored into the ground or other fixed structure and a stack of at least two boards extending between each pair of adjacent fence posts. Each board extends in a substantially horizontal orientation relative to the upright fence posts and is supported at each end by a respective fence post. At least one pair of retaining components are provided on each fence post and each pair of retaining components forms a series of cavities that are each shaped to receive and retain a respective end of a board of the stack to thereby support the respective end of the board at the fence post.

Other patents describing the closest subject matter provide for a number of more or less complicated features that fail to solve the problem in an efficient and economical way. None of these patents suggest the novel features of the present invention.

SUMMARY OF THE INVENTION

The present invention is a fence system, comprising a plurality of panel assembly that interconnect to one another, whereby first and second interlocking structures extend along planes of each panel assembly to mount onto an adjacent panel assembly. The first interlocking structure comprises an intermediate wall and the second interlocking structure comprises a fastening wall that hides a fastener passing through the intermediate wall when panel assemblies of the plurality of panel assembly are interconnected to one another. The plurality of panel assembly mounts onto at least two posts.

The panel assembly comprises a panel having first and second ends, an interior face, and in a preferred embodiment, the panel is rectangular in shape.

The first interlocking structure further comprises a panel end wall and a first interconnecting wall. The first interlocking structure extends from the first end, whereby the panel end wall perpendicularly extends from the first end. The intermediate wall perpendicularly extends from the panel end wall. The first interconnecting wall perpendicularly extends from the intermediate wall.

The second interlocking structure further comprises first and second extension walls, and a second interconnecting wall. The second interconnecting wall perpendicularly extends from the second end. The second extension wall perpendicularly extends from the panel at a predetermined distance from the second end. The fastening wall perpendicularly extends from the second extension wall. The first extension wall perpendicularly extends from the fastening wall towards the panel.

The first and second interconnecting walls are substantially parallel, and comprise approximately a same area and shape. The panel end wall and the second interconnecting wall extend parallel from the panel in a same direction. The first and second extension walls are substantially parallel and extend from the fastening wall an equal predetermined length. The first interconnecting wall comprises an interconnecting wall end, and the first extension wall comprises an extension wall end. The interconnecting wall end and the extension wall end are relatively aligned, on a same plane, with the interior face to allow for panel assemblies of the plurality panel assembly to interconnect and secure to one another. The first interlocking structure is U-shaped, and the second interlocking structure is G-shaped.

It is therefore one of the main objects of the present invention to provide a fence system.

It is another object of this invention to provide a fence system with interlocking panels.

It is another object of this invention to provide a fence system having interlocking panels with hidden fasteners.

It is another object of this invention to provide a fence system that can be readily assembled and disassembled without the need of any special tools.

It is another object of this invention to provide a fence system, which is of a durable and reliable construction.

It is yet another object of this invention to provide a fence system that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
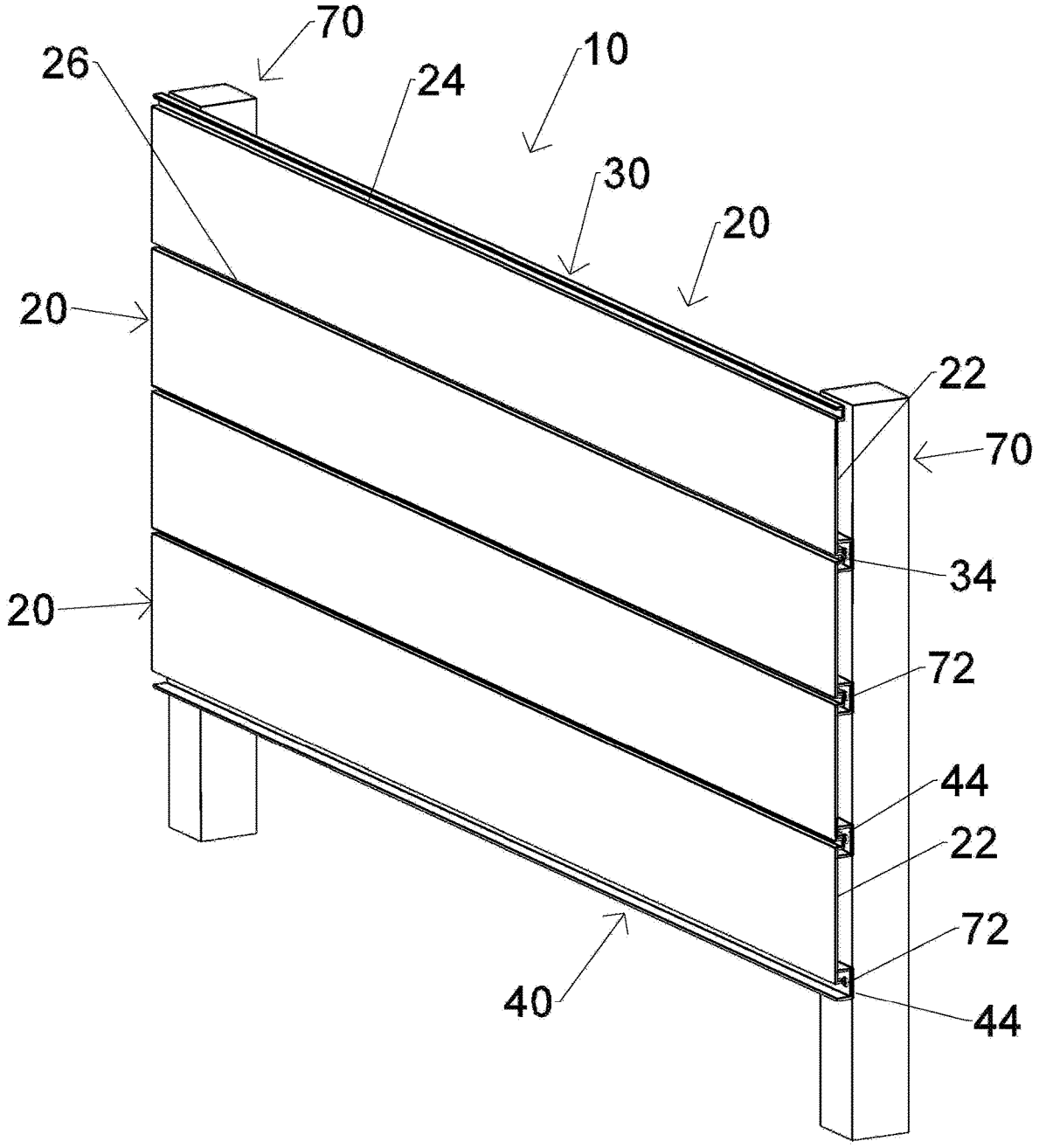
FIG. 1 is a front isometric view of the present invention.

Referring now to the drawings, the present invention is a fence system, and is generally referred to with numeral 10. It can be observed that it basically includes a plurality of panel assembly 20, and at least two posts 70.

Figure 2:
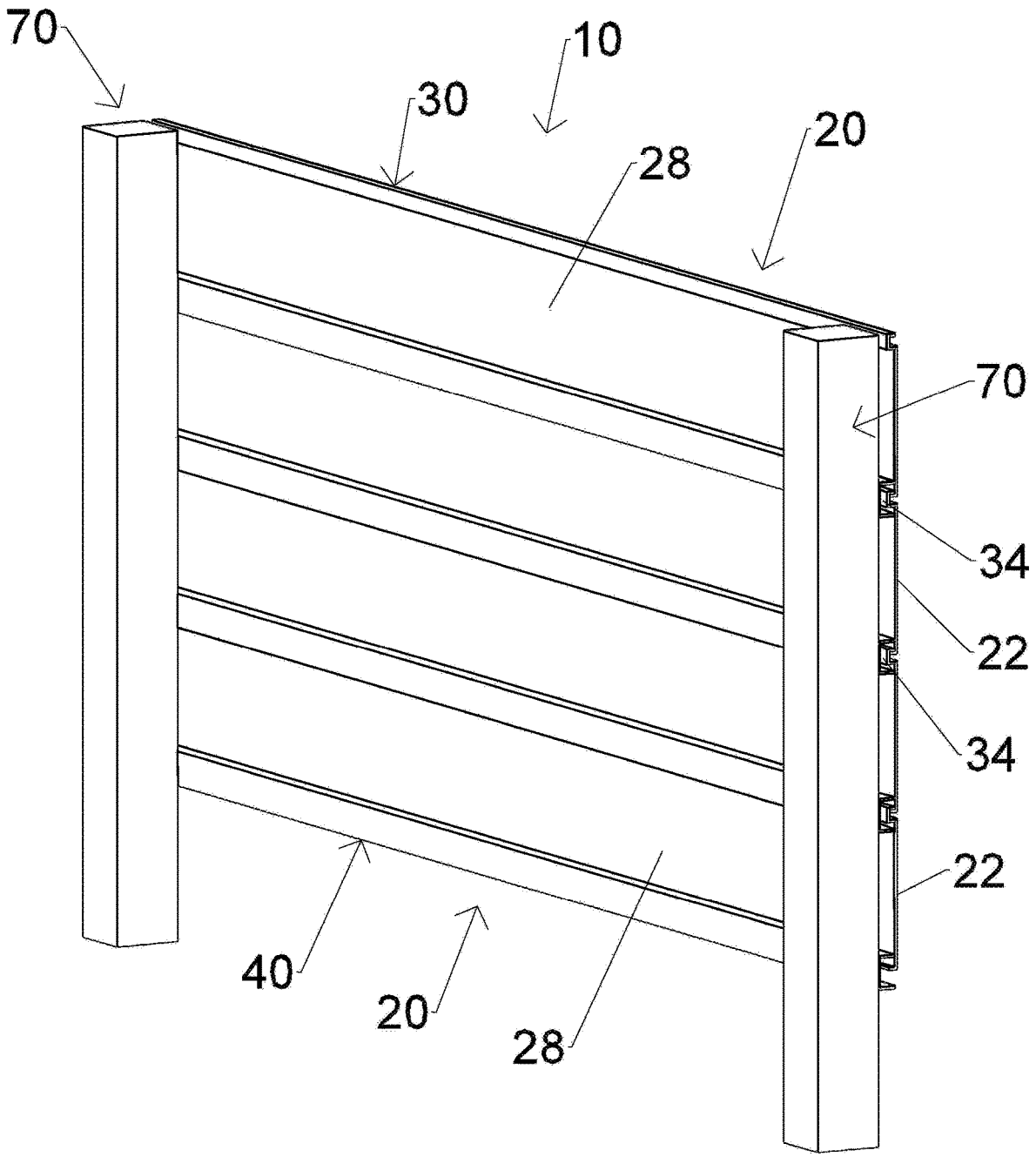
FIG. 2 is a rear isometric view of the present invention.

As seen in FIGS. 1 and 2, in a preferred embodiment, a plurality of panel assembly 20 are in a horizontal configuration and interconnect vertically to one another, whereby interlocking structures 30 and 40 extend along horizontal planes of each respective panel assembly 20 to mount upwardly or downwardly onto an adjacent panel assembly 20. Furthermore, each panel assembly 20 is mounted onto posts 70, whereby fastening walls 44 are secured onto respective posts 70. Each fastening wall 44 is secured onto a respective post 70 with a respective fastener 72, whereby fastener 72 is hidden behind intermediate wall 34 when the plurality of panel assembly 20 are interconnected to each other. In a preferred embodiment, fastener 72 is a screw. Specifically, fastening wall 44 hides fastener 72 passing through intermediate wall 34 when plurality of panel assembly 20 is interconnected to one another.

Figure 3A:
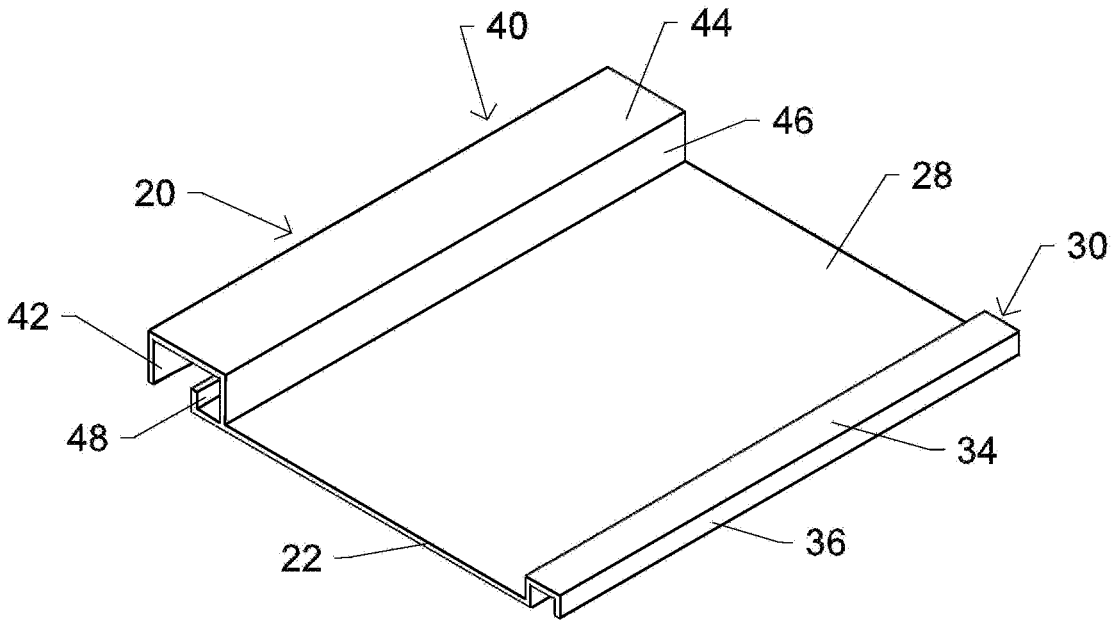
FIG. 3A is a rear isometric view of a panel assembly section.
Figure 3B:
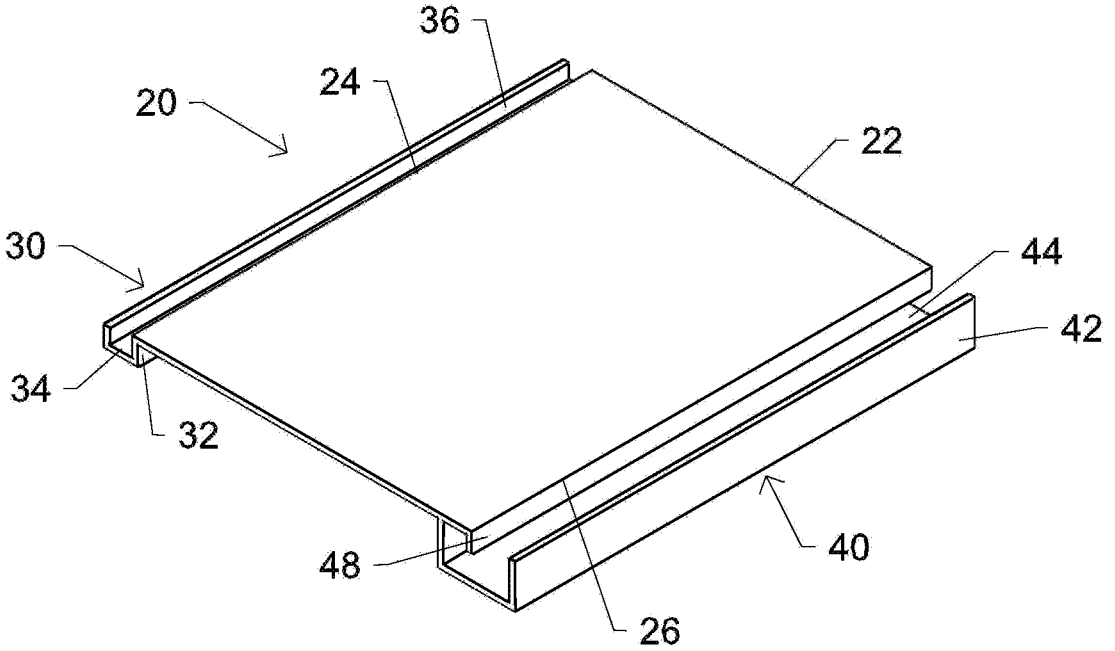
FIG. 3B is a front isometric view of the panel assembly section seen in FIG. 3A.

As seen in FIGS. 3A and 3B, each panel assembly 20 comprises first and second interlocking structures 30 and 40. In addition, panel assembly 20 comprises panel 22 having first and second ends 24 and 26, and interior face 28. In a preferred embodiment, panel 22 is rectangular in shape.

Figures 4A, 4B:
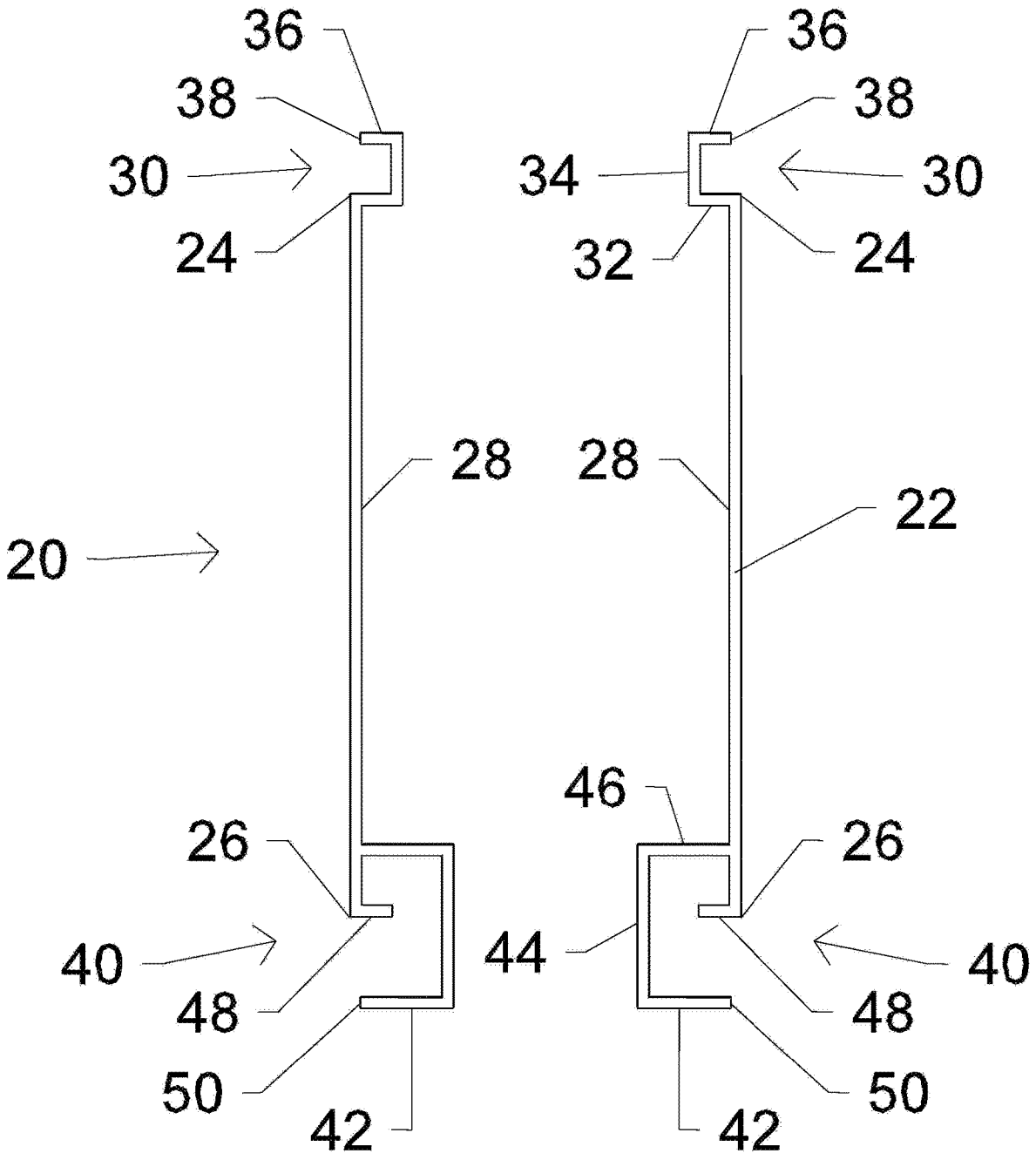
FIG. 4A is a left lateral view of the panel assembly.
FIG. 4B is a right lateral view of the panel assembly.

As seen in FIGS. 4A and 4B, first interlocking structure 30 comprises panel end wall 32, intermediate wall 34, and first interconnecting wall 36. First interlocking structure 30 extends from first end 24, whereby panel end wall 32 perpendicularly extends from first end 24. Intermediate wall 34 perpendicularly extends from panel end wall 32, and first interconnecting wall 36 perpendicularly extends from intermediate wall 34.

Second interlocking structure 40 comprises first and second extension walls 42 and 46, fastening wall 44, and second interconnecting wall 48. Second interlocking structure 40 is generally located at second end 26, whereby second interconnecting wall 48 perpendicularly extends from second end 26 and second extension wall 46 perpendicularly extends from panel 22 at a predetermined distance from second end 26. Fastening wall 44 perpendicularly extends from second extension wall 46, and first extension wall 42 perpendicularly extends from fastening wall 44 towards panel 22.

First and second interconnecting walls 36 and 48 are substantially parallel and comprise approximately a same area and shape. Panel end wall 32 and second interconnecting wall 48 extend parallel from panel 22 in a same direction. First and second extension walls 42 and 46 are substantially parallel and extend from fastening wall 44 an equal predetermined length.

First interconnecting wall 36 comprises interconnecting wall end 38, and first extension wall 42 comprises extension wall end 50. Interconnecting wall end 38 and extension wall end 50 are relatively aligned, on a same plane, with interior face 28 to allow for the plurality of panel assembly 20 to properly interconnect and secure to one another. It is noted that first interlocking structure 30 is U-shaped, and second interlocking structure 40 is G-shaped.

Figure 5:
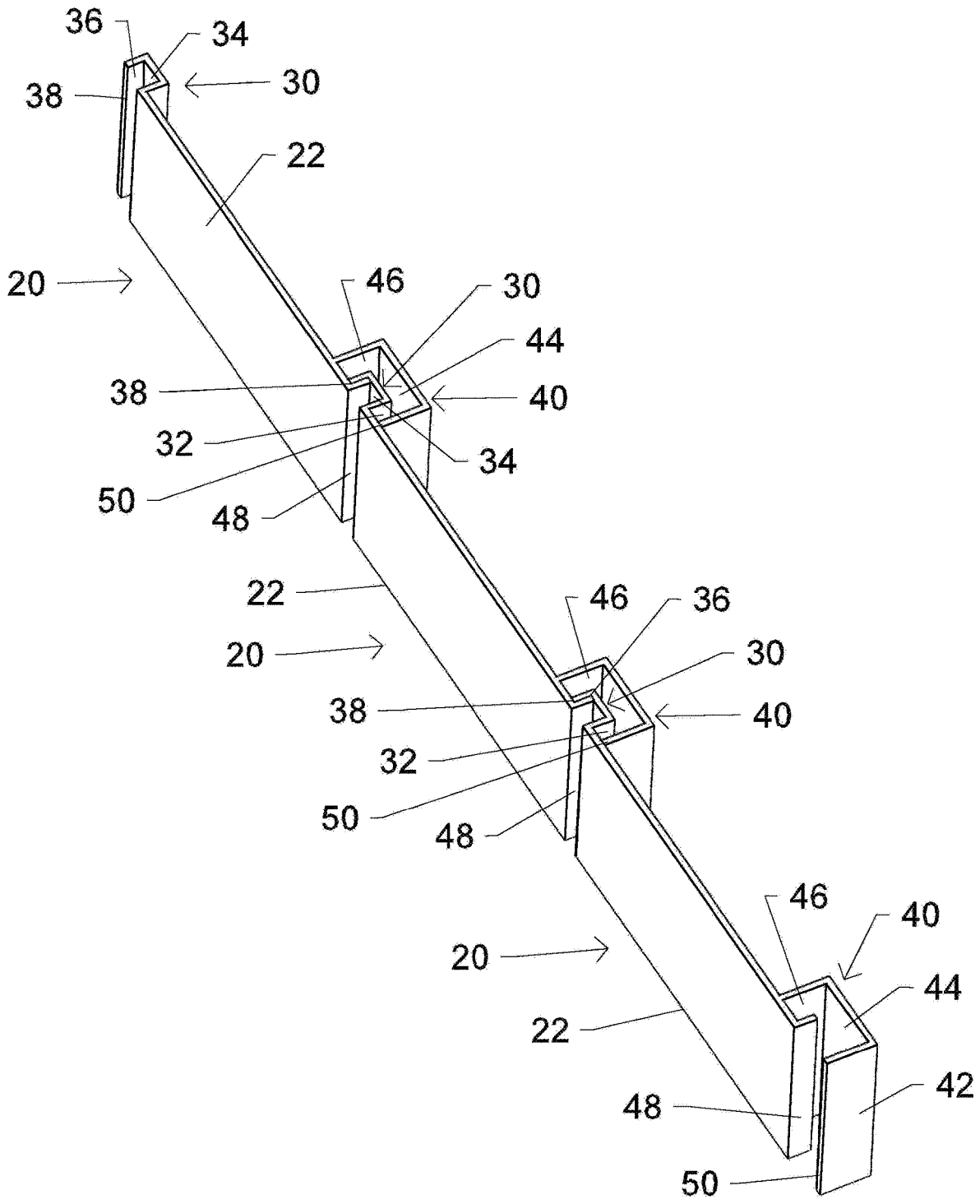
FIG. 5 is an isometric view of a plurality of panel assembly interconnected.
Figure 6:
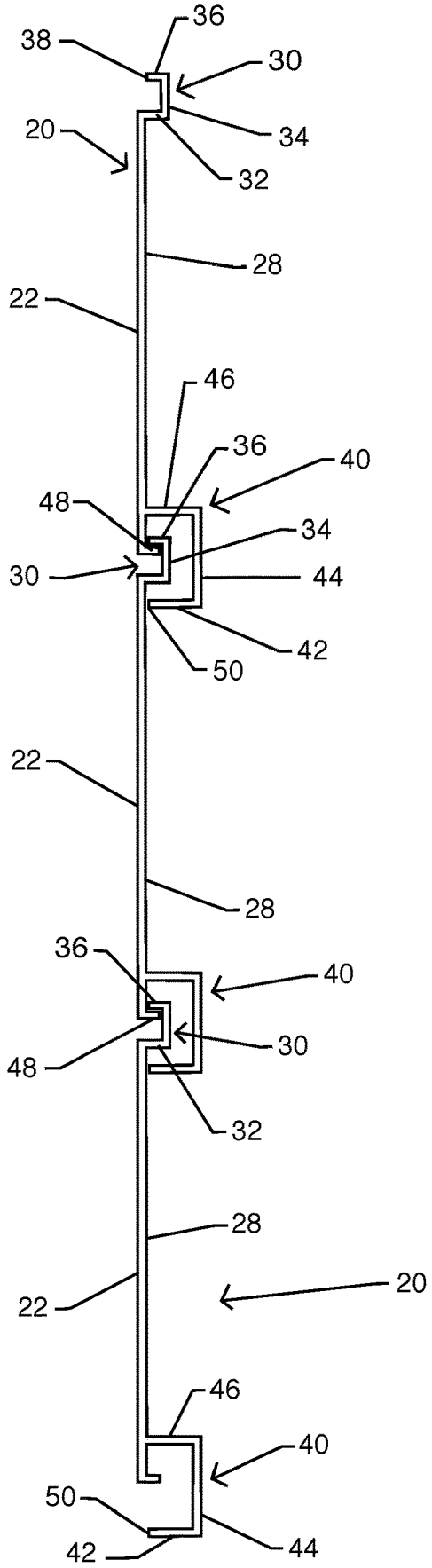
FIG. 6 is a left lateral view of a plurality of panel assembly interconnected.

As seen in FIGS. 5 and 6, in an alternate embodiment, a plurality of panel assembly 20 are in a vertical configuration and interconnect horizontally to one another, whereby interlocking structures 30 and 40 extend along vertical planes of each respective panel assembly 20 to mount sideways onto an adjacent panel assembly 20.

Specifically, a first interlocking structure 30 of a first panel assembly 20 interlocks with a second interlocking structure 40 of a second panel assembly 20, whereby the first interlocking structure 30 of the first panel assembly 20 is inserted within the second interlocking structure 40 of the second panel assembly 20. When the first panel assembly 20 interlocks with the second panel assembly 20, a first interconnecting wall 36 of the first panel assembly 20 and the second interconnecting wall 48 of the second panel assembly 20 firmly contact one another to be secured to one another. Furthermore, when the first panel assembly 20 interlocks with the second panel assembly 20, a respective intermediate wall 34 and a respective fastening wall 44 are substantially parallel. First and second extension walls 42 and 46 extend a first predetermined distance from panel 22, and panel end wall 32 and first interconnecting wall 36 extend a second predetermined distance from panel 22. The first predetermined distance is greater than the second predetermined distance.

Furthermore, the plurality of panel assembly 20 are mounted onto crossbars, not seen, that mount onto posts 70, seen in FIG. 1, whereby fastening walls 44 are secured onto respective the crossbars that mount onto posts 70. Each fastening wall 44 is secured onto a respective crossbar that mounts onto posts 70 with a respective fastener 72, seen in FIG. 1, whereby fastener 72 is hidden behind intermediate wall 34 when the plurality of panel assembly 20 are interconnected to each other. In a preferred embodiment, fastener 72 is a screw.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A fence system, comprising:

A) a plurality of panel assemblies that interconnect to one another, whereby first and second interlocking structures extend along planes of each said panel assembly to mount onto an adjacent said panel assembly, wherein said first interlocking structure comprises an intermediate wall and said second interlocking structure comprises a fastening wall that hides a fastener passing through said intermediate wall when said plurality of panel assemblies is interconnected to one another, each of said panel assemblies comprises a panel having first and second ends, said first interlocking structure further comprises a panel end wall and a first interconnecting wall, said first interlocking structure extends from said first end, whereby said panel end wall perpendicularly extends from said first end, said intermediate wall perpendicularly extends from said panel end wall, said first interconnecting wall perpendicularly extends from said intermediate wall, said second interlocking structure further comprises first and second extension walls, and a second interconnecting wall, said second interconnecting wall perpendicularly extends from said second end, said second extension wall perpendicularly extends from said panel at a predetermined distance from said second end, said fastening wall perpendicularly extends from said second extension wall beyond said second end, said first extension wall perpendicularly extends from said fastening wall towards said panel, said first interlocking structure is geometric U-shaped, and said second interlocking structure is geometric G-shaped; and B) at least two posts.

2. The fence system set forth in claim 1, further characterized in that said plurality of panel assemblies is mounted onto said posts.

3. The fence system set forth in claim 1, further characterized in that each of said panel assemblies comprises an interior face.

4. The fence system set forth in claim 1, further characterized in that said panel is rectangular in shape.

5. The fence system set forth in claim 1, further characterized in that said first and second interconnecting walls are substantially parallel.

6. The fence system set forth in claim 5, further characterized in that said first and second interconnecting walls comprise approximately a same area and shape.

7. The fence system set forth in claim 6, further characterized in that said panel end wall and said second interconnecting wall extend parallel from said panel in a same direction.

8. The fence system set forth in claim 7, further characterized in that said first and second extension walls are substantially parallel and extend from said fastening wall an equal predetermined length.

9. The fence system set forth in claim 8, further characterized in that said first interconnecting wall comprises an interconnecting wall end, and said first extension wall comprises an extension wall end, said interconnecting wall end and said extension wall end are relatively aligned, on a same plane, with said interior face to allow for said plurality of panel assemblies to interconnect and secure to one another.

* * * * *